US009213252B2

(12) United States Patent
Hiraide

(10) Patent No.: US 9,213,252 B2
(45) Date of Patent: Dec. 15, 2015

(54) TRANSPARENT DEVELOPER, DEVELOPER HOUSING, DEVELOPMENT DEVICE, AND IMAGE FORMATION APPARATUS

(71) Applicant: Oki Data Corporation, Tokyo (JP)

(72) Inventor: Manami Hiraide, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/482,162

(22) Filed: Sep. 10, 2014

(65) Prior Publication Data

US 2015/0072280 A1 Mar. 12, 2015

(30) Foreign Application Priority Data

Sep. 11, 2013 (JP) ..... 2013-188527

(51) Int. Cl.

| | |
|---|---|
| ***G03G 9/00*** | (2006.01) |
| ***G03G 15/01*** | (2006.01) |
| ***G03G 9/08*** | (2006.01) |
| ***G03G 15/00*** | (2006.01) |

(52) U.S. Cl.

CPC ..... *G03G 15/0121* (2013.01); *G03G 9/08* (2013.01); *G03G 9/0821* (2013.01); *G03G 15/6585* (2013.01)

(58) Field of Classification Search

CPC ..... G03G 9/08; G03G 9/10

See application file for complete search history.

(56) References Cited

U.S. PATENT DOCUMENTS

| | | | | |
|---|---|---|---|---|
| 5,935,752 | A * | 8/1999 | Ueda | G03G 9/09733 430/108.1 |
| 2007/0048653 | A1* | 3/2007 | Ide | G03G 5/144 430/123.52 |
| 2010/0261108 | A1* | 10/2010 | Yamanouchi | G03G 9/08711 430/97 |
| 2012/0134724 | A1* | 5/2012 | Kageyama | G03G 15/1625 399/329 |

FOREIGN PATENT DOCUMENTS

| | | | |
|---|---|---|---|
| JP | 2010-513950 | A | 4/2010 |
| JP | 2011-008127 | A | 1/2011 |
| JP | 2012-032774 | A | 2/2012 |
| JP | 2012-032775 | A | 2/2012 |
| JP | 2012-208217 | A | 10/2012 |
| JP | 2013-117583 | A | 6/2013 |
| JP | 2013-121709 | A | 6/2013 |
| JP | 2013-142894 | A | 7/2013 |
| JP | 2013-257363 | A | 12/2013 |
| JP | 2014-174444 | A | 9/2014 |

* cited by examiner

*Primary Examiner* — Hoa V Le

(74) *Attorney, Agent, or Firm* — Marvin A. Motsenbocker; Mots Law, PLLC

(57) ABSTRACT

A transparent developer has a glass transition point of 63.0° C. to 66.0° C., both inclusive, and a melt temperature, indicative of a softening point by a 1/2 method, of 94.3° C. to 97.0° C., both inclusive.

10 Claims, 5 Drawing Sheets

TRANSPARENT DEVELOPER, DEVELOPER HOUSING, DEVELOPMENT DEVICE, AND IMAGE FORMATION APPARATUS

CROSS REFERENCE TO RELATED APPLICATIONS

This application claims priority based on 35 USC 119 from prior Japanese Patent Application No. 2013-188527 filed on Sep. 11, 2013, entitled "TRANSPARENT DEVELOPER, DEVELOPER HOUSING, DEVELOPMENT DEVICE, AND IMAGE FORMATION APPARATUS", the entire contents of which are incorporated herein by reference.

BACKGROUND OF THE INVENTION

1. Field of the Invention

The disclosure relates to a transparent developer, a developer housing, a development device, and an image formation apparatus, and is applicable, for example, to a developer, a developer housing, a development device, and an image formation apparatus to be used in an electrophotographic image formation apparatus or the like.

2. Description of Related Art

One type of electrophotographic image formation apparatus that is capable of forming color images is what is termed a tandem-type image formation apparatus (see Japanese Patent Application Publication No. 2013-117583). A tandem-type image formation apparatus includes an array of photoreceptor drums for different colors such as Y (yellow), M (magenta), C (cyan), and K (black) along an intermediate transfer belt, and sequentially transfers toner images (developer images) formed on the respective photoreceptor drums to the intermediate transfer belt so that the toner images (developer images) are superposed on one another to form a multilayer. The multilayer of the color toner images transferred to the intermediate transfer belt is secondarily transferred together on a record medium such as paper in a secondary transfer position.

In addition, tandem-type image formation apparatuses include those providing prints with partial glossiness (namely, spot gloss) by using a transparent toner in addition to a color toner. Such partial glossiness is formed by generating a difference in glossiness between color toner areas and transparent toner areas or a difference in glossiness between transparent toner areas and toner-less non-image areas.

When tandem-type image formation apparatuses use transparent toner in order to generate a difference in glossiness from the color toner areas in prints, it is necessary that a transparent toner layer and multiple toner layers of Y, M, and C colors be laminated on the intermediate transfer belt, and these laminated toner images be secondarily transferred together to a record medium.

In this case, a problem arises in that some laminated toner images may spread to cause blurred printing easily on record media. Particularly when transferring fine toner images such as line figures and letters to record media, toner spreading is so noticeable that the quality of the finally-obtained images is decreased.

A possible cause for such toner spreading is that the thickness of the laminated toner layers is too large to strongly hold the toner layers on the intermediate transfer belt, and therefore some of toner in an upper part of the toner layers spreads to the record medium surface before the application of a secondary transfer voltage.

Against this background, to prevent the toner spreading, it is desired to enable a strong holding of the toner layers on the intermediate transfer belt by reducing the thickness of the toner layers laminated on the intermediate transfer belt (i.e., reducing the amount of toner applied per unit area on the record medium).

SUMMARY OF THE INVENTION

However, a reduction in the thickness of color toner layers laminated on the intermediate transfer belt is not desirable because such a reduction changes the color tone of a print. To address this, it may be desirable to make the toner layer of the transparent toner thinner among the toner layers laminated. However, the formation of such a thinner transparent toner layer may cause another problem in that the glossiness of the transparent toner areas in prints decreases and accordingly the effect of spot gloss decreases.

Prevention of the aforementioned toner spreading is a problem common to both tandem-type image formation apparatuses providing spot gloss and conventional other types of image formation apparatuses.

Therefore, it is an object of an embodiment of the invention to provide a transparent developer capable of preventing developer spreading in the developer transfer so to form high quality images even while reducing the amount of transparent developer applied to the record media but at the same time ensuring the glossiness of image areas containing the transparent developer.

An aspect of the invention is a transparent developer with a glass transition point of 63.0° C. to 66.0° C., both inclusive, and a melt temperature, indicative of a softening point by a 1/2 method, of 94.3° C. to 97.0° C., both inclusive.

According to the above aspect of the invention, the developer spreading can be prevented in the developer transfer to form quality images while reducing the amount of transparent developer applied to the record media but while ensuring the glossiness of the image areas containing the transparent developer.

DETAILED DESCRIPTION OF EMBODIMENTS

Figure 1:
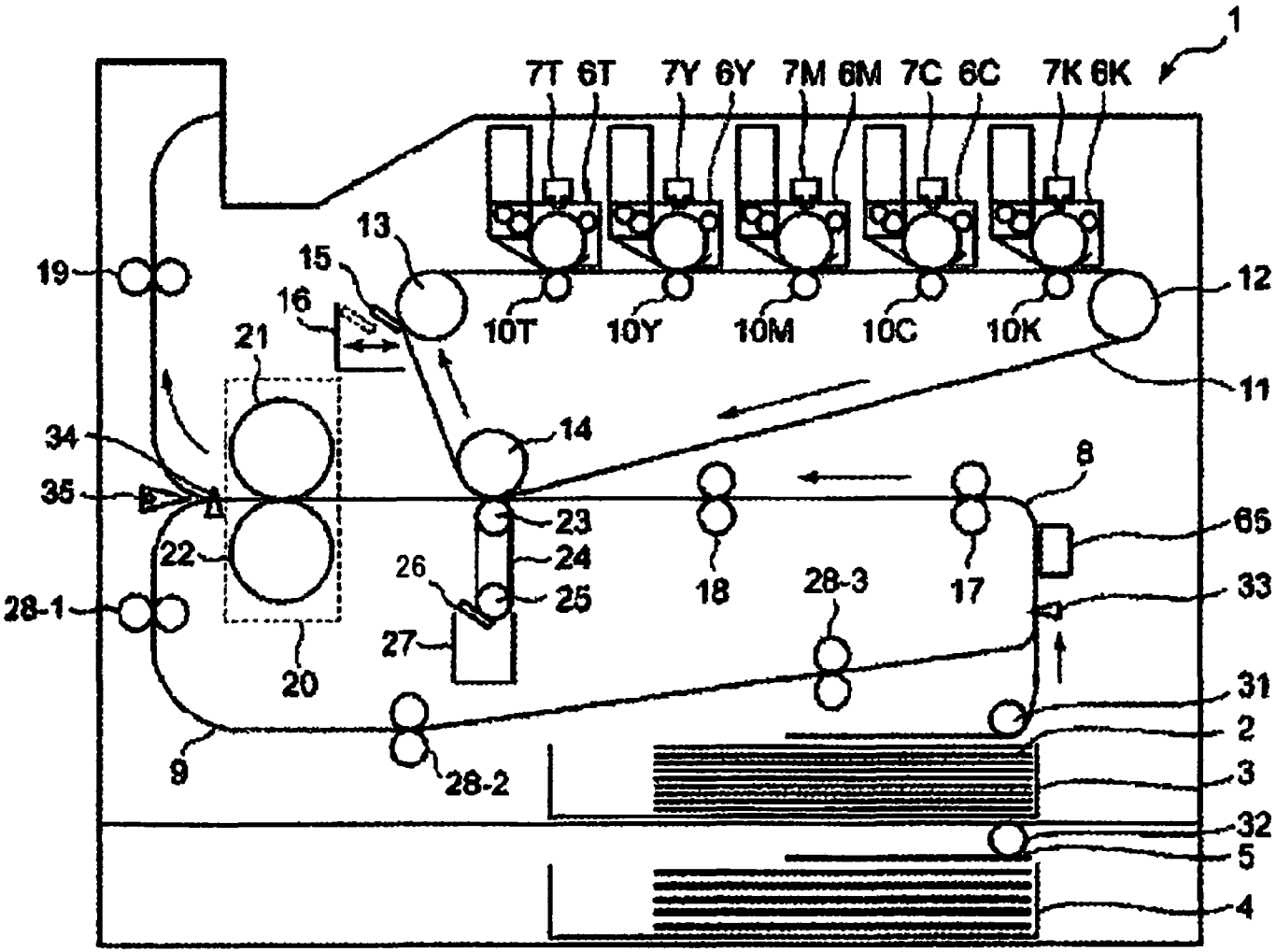
FIG. 1 is an internal configuration diagram illustrating the internal configuration of an image formation apparatus according to an embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

(A) An Embodiment

A transparent developer, developer housing, development device, and image formation apparatus according to an embodiment of the invention is described below in detail with reference to the drawings.

(A-1) Configuration of the Embodiment

This embodiment illustrates the case where the invention is applied to a tandem-type image formation apparatus using a transparent developer (hereinafter also referred to as a transparent toner) produced by the dissolution suspension method. Although this embodiment is described given that the image formation apparatus is a printer, the image formation apparatus is not limited to a printer and can include various apparatuses such as copying machines and facsimiles.

(A-1-1) Configuration of the Image Formation Apparatus

FIG. 1 is an internal configuration diagram illustrating the internal configuration of image formation apparatus 1 according to this embodiment. Image formation apparatus 1 illustrated in FIG. 1 is capable of both double-sided printing and image formation on either of two types of record media. However, image formation apparatus 1 may be an image formation apparatus capable of single-sided printing or capable of image formation on one type of record medium.

In FIG. 1, image formation apparatus 1 includes first medium storage cassette 3, second medium storage cassette 4, image formation units 6T, 6Y, 6M, 6C, and 6K, exposure devices 7T, 7Y, 7M, 7C, and 7K, conveyance path 8, reconveyance path 9, primary transfer rollers 10T, 10Y, 10M, 10C, and 10K, intermediate transfer belt 11, drive roller 12, belt driven roller 13, secondary transfer bias roller 14, cleaning blade 15, cleaner container 16, a pair of resist rollers 17, a pair of conveyance rollers 18, delivery roller 19, fixer 20, heat roller 21, press roller 22, secondary transfer roller 23, secondary transfer belt 24, drive roller 25, cleaning blade 26, cleaner container 27, pairs of reconveyance rollers 28-1, 28-2, 28-3, hopping rollers 31 and 32, writing sensor 33, delivery sensor 34, and conveyance separator 35.

A "secondary transfer unit" described in the claims includes secondary transfer bias roller 14, secondary transfer roller 23, secondary transfer belt 24, and drive roller 25. Intermediate transfer belt 11 is an example of the "intermediate transfer member" described in the claims.

First medium storage cassette 3 stores a stack of record media 2 such as paper. Second medium storage cassette 4 stores a stack of record media 5 such as paper.

First and second medium storage cassettes 3 and 4 are, for example, detachably installed in the lower part of image formation apparatus 1. Hopping rollers 31 and 32 feed out record media 2 and 5 stored in first and second medium storage cassettes 3 and 4 respectively one by one from the top, and convey record media 2 and 5 out to conveyance path 8 in the direction of the arrow.

Image formation units 6T, 6Y, 6M, 6C, and 6K form images on record media 2 and 5. Image formation units 6T, 6Y, 6M, 6C, and 6K may be detachably installed in image formation apparatus 1. Image formation units 6T, 6Y, 6M, 6C, and 6K include photoreceptor drums configured to form transparent (T) images and photoreceptor drums configured to form different color images of Y (yellow), M (magenta), C (cyan), and K (black), respectively in the rotation direction (the direction of the arrow in FIG. 1) of intermediate transfer belt 11. The photoreceptor drums are arranged along intermediate transfer belt 11. Image formation units 6T, 6Y, 6M, 6C, and 6K each form toner images (developer images) on the photoreceptor drums exposed to neighboring exposure devices 7T, 7Y, 7M, 7C, and 7K. Although exposure devices 7T, 7Y, 7M, 7C, and 7K can widely employ various exposure devices, as one example, LED heads are used in this embodiment.

Primary transfer rollers 10T, 10Y, 10M, 10C, and 10K are arranged in the positions facing the photoreceptor drums of image formation units 6T, 6Y, 6M, 6C, and 6K, respectively. Toner images on the photoreceptor drums of image formation units 6T, 6Y, 6M, 6C, and 6K are transferred to intermediate transfer belt 11 through Coulomb force. This allows the toner layers of respective colors to be laminated on intermediate transfer belt 11.

Image formation units 6T, 6Y, 6M, 6C, and 6K are all the same in terms of their configuration and are different in the toner color used. Although FIG. 1 illustrates the case where five image formation units 6T, 6Y, 6M, 6C, and 6K including one for the transparent toner are provided, four image formation units without image formation unit 6K of K (black) may be provided.

Intermediate transfer belt 11 is stretched between drive roller 12, belt driven roller 13 and secondary transfer bias roller 14, and is rotated by drive roller 12. The upper surface of intermediate transfer belt 11 is movably disposed between primary transfer rollers 10T, 10Y, 10M, 10C, and 10K and image formation units 6T, 6Y, 6M, 6C, and 6K. The toner images thus formed by image formation units 6T, 6Y, 6M, 6C, and 6K are transferred all at once to intermediate transfer belt 11. Intermediate transfer belt 11 is formed without any joint or end, and a semiconductive plastic film of high resistance and the like can be used for it.

Cleaning blade 15 is disposed downstream of secondary transfer bias roller 14 in the rotation direction of intermediate transfer belt 11, and is configured to scrape off the toner on intermediate transfer belt 11. Cleaning blade 15 is laterally movable from the position indicated by the dotted line in FIG. 1. Cleaning blade 5 can be distant from intermediate transfer belt 11 by moving cleaning blade 15 to the position of the dotted line in FIG. 1.

Cleaner container 16 receives the toner scraped off of cleaning blade 15.

Secondary transfer belt 24 is stretched between secondary transfer roller 23 and drive roller 25, and is rotated by drive roller 25. Secondary transfer roller 23 is provided facing secondary transfer bias roller 14, and both sandwich intermediate transfer belt 11, record medium 2 or 5, and secondary transfer belt 24 therebetween. The toner image once transferred to intermediate transfer belt 11 is thus transferred to record medium 2 or 5. Secondary transfer belt 24 is formed without any joint or end, and a semiconductive plastic film of high resistance and the like can be used for it.

Cleaning blade 26 abuts on secondary transfer belt 24 in the position facing drive roller 25, and scrapes off the toner on secondary transfer belt 24.

Cleaner container 27 receives adherent materials, such as toner, scraped off by cleaning blade 26.

Resist roller 17 and conveyance roller 18 convey record medium 2 or 5 from conveyance path 8 to a nip for intermediate transfer belt 11 and secondary transfer belt 24 at predetermined timings.

Fixer 20 heats, fuses, and presses the toner applied to record medium 2 or 5 with heat roller 21 as a heating member and with press roller 22 as a press member to fix toner images on record medium 2 or 5. Record medium 2 or 5, after fixation, is conveyed to reconveyance path 9 which is configured to reconvey record medium 2 or 5, or to deliver it to the outside of the apparatus by a selection made in the operation of conveyance separator 35 which is driven by a driving unit (not illustrated).

Heat roller 21 includes, for example, a hollow cylindrical core bar made of aluminum or other material, a heat-resistant elastic layer of silicone rubber covering the core bar, and a PFA (tetrafluoroethylene-perfluoroalkyl vinyl ether copolymer) tube covering the heat-resistant elastic layer. Furthermore, heat roller 21 includes a heater (halogen lamp, here) in the core bar.

Press roller 22 includes, for example, a core bar made of aluminum or other material, a heat-resistant elastic layer of silicone rubber covering the core bar, and a PFA tube covering the heat-resistant elastic layer. Press roller 22 is disposed so as to have a part of the press roller be in pressure contact with heat roller 21.

Reconveyance path 9 is transported by reconveyance rollers 28-1, 28-2, and 28-3, and delivers record medium 2 or 5 to conveyance path 8. Delivery to the outside of the apparatus is done by delivery roller 19. Writing sensor 33 and delivery sensor 34 are mechanical sensors configured to recognize the passage of record medium 2 or 5, and each operates whenever record medium 2 or 5 passes by sensor 33 or 34.

(A-1-2) Configuration of the Development Device

Figure 2:
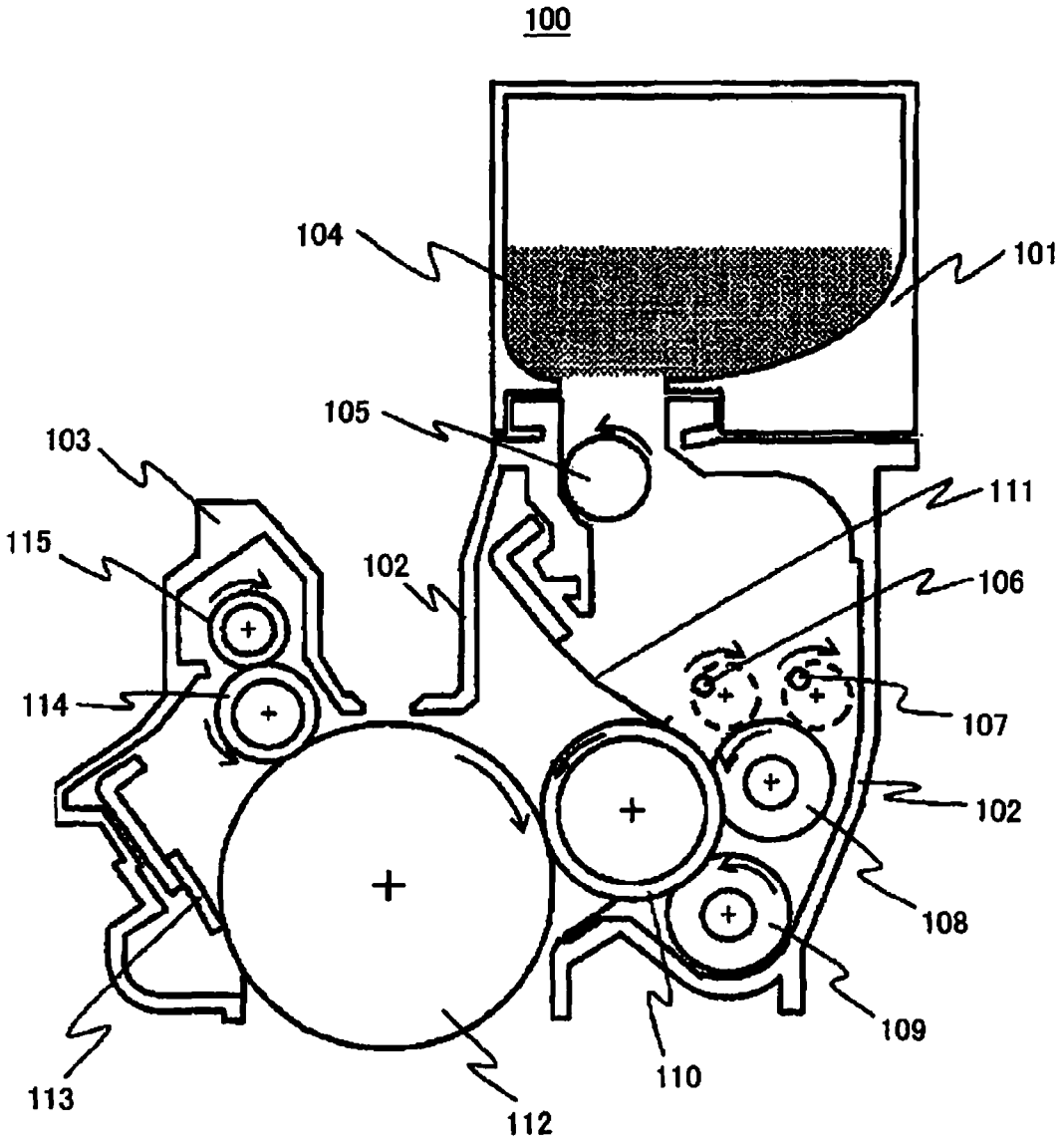
FIG. 2 is a cross-sectional diagram illustrating the internal configuration of a development device according to the embodiment.

FIG. 2 is a cross-sectional diagram illustrating the internal configuration of development device 100 according to the embodiment. FIG. 2 illustrates the configuration of development device 100 of image formation unit 6T using transparent (T) toner, representative of image formation units 6T, 6Y, 6M, 6C, and 6K.

In FIG. 2, development device 100 roughly includes toner container 101 as a developer housing, development unit 102, and drum unit 103.

Toner container 101 is a developer housing capable of storing toner 104. Toner container 101 stores a transparent toner for electrostatic charge development, produced, for example, by the dissolution suspension method, as described below, and having a glass transition temperature ($T_g$) of 63.0° C. to 66.0° C., both inclusive, and a melt temperature ($T_{1/2}$), indicative of a softening point in the 1/2 method, of 94.3° C. to 97.0° C., both inclusive.

Figure 3:
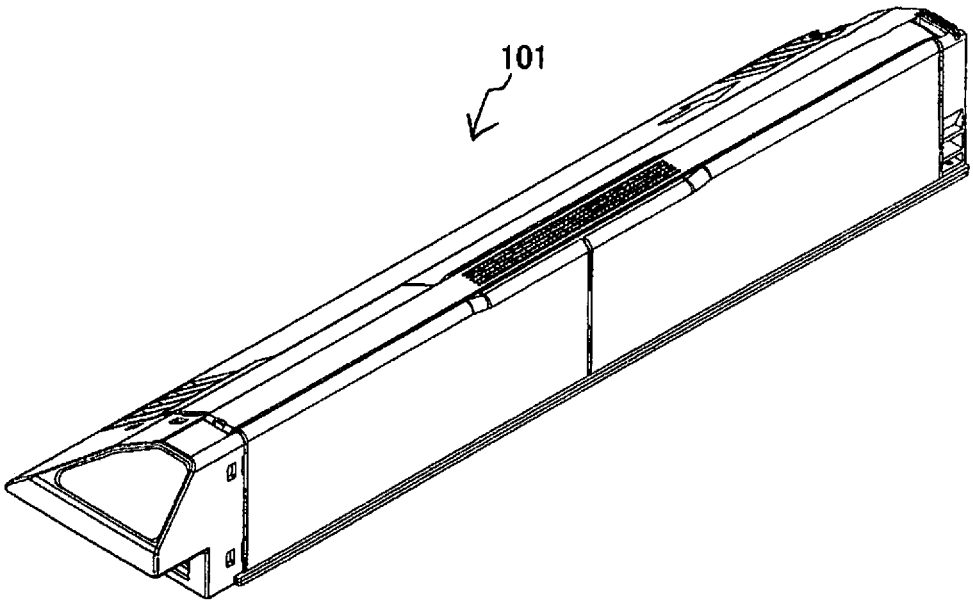
FIG. 3 is an appearance perspective view of a toner container as a developer housing according to the embodiment (part 1)
Figure 4:
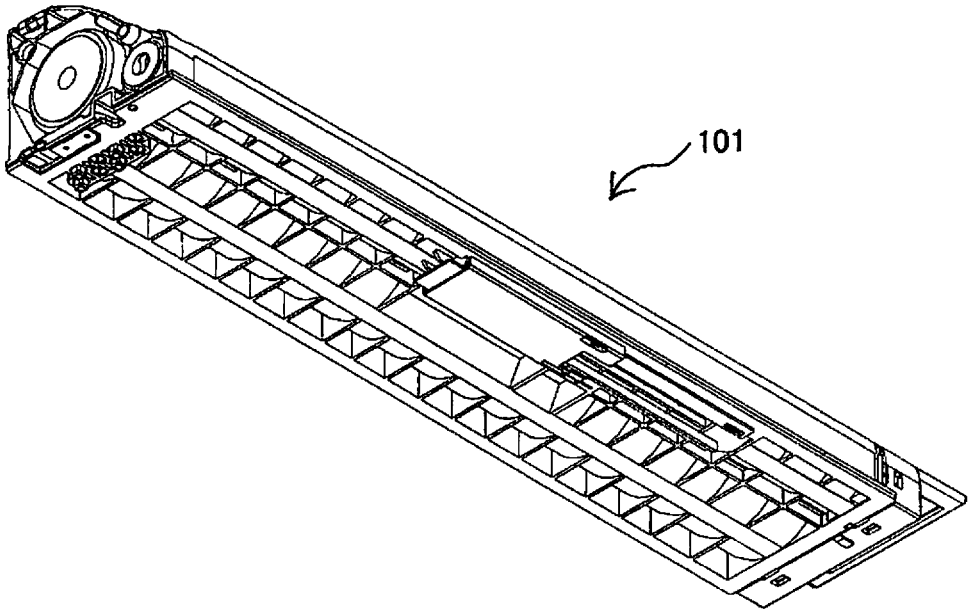
FIG. 4 is an appearance perspective view of a toner container as a developer housing according to the embodiment (part 2)

FIGS. 3 and 4 are appearance perspective views of toner container 101 as the developer housing. FIG. 3 is an appearance perspective view from above toner container 101, and FIG. 4 is an appearance perspective view from below toner container 101. Toner container 101 is detachably installed in development device 100.

Development unit 102 and drum unit 103 include stir member 105 and stir members 106 and 107 configured to stir toner 104 in development unit 102 to prevent solidification and an uneven distribution of toner 104. Toner 104 is supplied from toner container 101, along with first toner supply roller 108, second toner supply roller 109, development roller 110, development blade 111, photoreceptor drum 112, cleaning blade 113, charge roller 114, and cleaning roller 115.

First and second toner supply rollers 108 and 109, which are examples of developer supply members, supply toner 104 as a developer to development roller 110 in sliding contact with first and second toner supply rollers 108 and 109. First and second toner supply rollers 108 and 109 include, for example, a metal shaft and a semiconductive foamed silicone sponge layer.

Development roller 110, which is an example of one type of developer carrier, carries toner 104 supplied from first and second toner supply rollers 108 and 109, and transfers toner 104 to electrostatic latent images on the surface of photoreceptor drum 112. Development roller 110 includes, for example, a metal shaft and a semiconductive foamed urethane rubber layer.

Development blade 111 removes residual toner 104 on the surface of development roller 110 while the end of development blade 111 is in contact with the circumferential surface of development roller 110.

Photoreceptor drum 112, which is an example of one type of an image carrier (developer image carrier), allows the electrostatic latent image formed by exposure device 7T in FIG. 1 to adsorb toner 104 from first and second toner supply rollers 108 and 109 to form a toner image (developer image). Photoreceptor drum 112 transfers the formed toner image to intermediate transfer belt 11 between photoreceptor drum 112 and primary transfer roller 10T. Photoreceptor drum 112 has, for example, a conductive support and a photoconductive layer. Specifically, photoconductive drum 112 is an organic photoreceptor having a laminate of a charge generation layer and a charge transport layer as the photoconductive layer around a metal pipe of aluminum as the conductive support.

Cleaning blade 113, which is an example of one type of a developer recovery member, is disposed in pressure contact with the surface of photoconductive drum 112 to recover residual toner 104 on the surface of photoconductive drum 112 after a transfer of the toner image. For cleaning blade 113, for example, a member made of urethane rubber can be used.

Charge roller 114, which is an example of one type of charge device, is provided in contact with the circumferential surface of photoreceptor drum 112 to charge the surface of photoreceptor drum 112. Charge roller 114 includes a metal shaft and a semiconductive epichlorohydrin rubber layer.

Cleaning roller 115 removes charge potential remaining on the surface of development roller 114.

(A-1-3) Image Formation Process

Next, the image formation process of image formation apparatus 1 according to the embodiment is described. Here, the development process is described first.

As illustrated in FIG. 2, photoconductive drum 112 is, for example, rotated in the arrow direction at a constant peripheral speed by a driving unit such as a motor. Charge roller 114 is provided in contact with the surface of photoconductive drum 112. While rotating in the arrow direction, charge roller 114 applies, for example, a direct current voltage from a high voltage power supply for the charge roller to the surface of photoconductive drum 112, uniformly charging the surface of photoconductive drum 112.

Next, exposure device 7T in FIG. 1, provided facing photoconductive drum 112, irradiates the uniformly charged surface of photoconductive drum 112 with light corresponding to image signals, causing an optical attenuation of potential in the light-exposed part to form an electrostatic latent image.

When toner container 101 is attached to development unit 102, for example, a shutter slides toward an opening by a lever operation or the like to be opened. This allows toner 104 of toner container 101 to drop down and supplies toner 104 to development unit 102.

In FIG. 2, first and second toner supply rollers 108 and 109 rotate in the arrow directions in FIG. 2, for example, by receiving voltage from a high voltage power supply for the supply roller, and thus supply toner 104 to development roller 110.

Development roller 110 is disposed in close contact with photoconductive drum 112 to receive voltage, for example, from a high voltage power supply for the development roller. Development roller 110 adsorbs toner 104 conveyed by first and second toner supply rollers 108 and 109, and conveys toner 114 while rotating in the arrow direction. In this case, development blade 111 is disposed in pressure contact with development roller 110 to form a toner layer having a uniform thickness of toner 104 adsorbed to development roller 110.

Furthermore, development roller 110 carries out a reversal development of the electrostatic latent image formed on photoconductive drum 112 with carried toner 104 in the following manner. Since a bias voltage is applied between the conductive support of photoconductive drum 114 and development roller 110 by a high voltage power supply, lines of electric force associated with the electrostatic latent image formed on photoconductive drum 112 are generated between development roller 110 and photoconductive drum 112. Accordingly, charged toner 104 on development roller 110 is attracted to the electrostatic latent image part on photoconductive drum 112 through electrostatic force, and this part is developed to form a toner image. Further development processes after rotation of photoconductive drum 112 are started at predetermined timings described below.

In FIG. 1, the toner images on the surfaces of respective photoreceptor drums 112 of image formation units 6T, 6Y, 6M, 6C, and 6K are transferred by primary intermediate transfer rollers 10T, 10Y, 10M, 10C, and 10K through a Coulomb force, so that toner layers of different colors are laminated on intermediate transfer belt 11.

The toner layers laminated on intermediate transfer belt 11 are conveyed toward secondary transfer belt 24 while being retained on intermediate transfer belt 11.

In FIG. 1, record medium 2 or 5 stored in first or second medium storage cassette 3 or 4 is taken out of first or second medium storage cassette 3 or 4 one by one in the arrow direction by hopping roller 31 or 32 as mentioned above.

Subsequently, record medium 2 or 5 is conveyed in the arrow direction by resist roller 17 and conveyance roller 18. Since record medium 2 or 5 is conveyed along a medium guide at this time, record medium 2 or 5 is conveyed with the bias being corrected. Then, record medium 2 or 5 is conveyed to secondary transfer belt 24. The above development process is started at a predetermined timing during the conveyance of record medium 2 or 5 in the arrow direction of conveyance path 8.

Next, the secondary transfer process is performed. Secondary transfer belt 24 is driven by drive roller 25 and secondary transfer roller 23. Secondary transfer bias roller 14 receives voltage from a high voltage power supply for the secondary transfer. The toner layers laminated on intermediate transfer belt 11 are conveyed between secondary transfer bias roller 14 and secondary transfer roller 23, and the toner layers on intermediate transfer belt 11 are transferred together to conveyed record medium 2 or 5.

Next, a fixation process is described. Record medium 2 or 5 having the toner image transferred together from intermediate transfer belt 11 is conveyed to fixation unit 20 including heat roller 21 and press roller 22.

For heat roller 21 of fixation unit 20, the fixation temperature is controlled, for example, by a temperature controller. Record medium 2 or 5 having the transferred toner image is then conveyed between rotating heat roller 21 and press roller 22. Then, the heat of heat roller 21 melts the toner image on record medium 2 or 5, and the pressure contact part between heat roller 21 and press roller 22 presses the melted toner image on record medium 2 or 5 to fix the toner image to record medium 2 or 5.

Record medium 2 or 5 having the fixed toner image is conveyed and delivered to the outside of image formation apparatus 1 by medium conveyance roller 19. In the case of double-sided printing, record medium 2 or 5 having the fixed toner image is conveyed along reconveyance path 9 by reconveyance rollers 28-1, 28-2, and 28-3, and is delivered to conveyance path 8. The image formation on the other side is performed in the same manner as described above.

(A-1-4) Transparent Toner for Electrostatic Charge Development

Next, a transparent toner according to this embodiment is described with reference to the drawings.

The transparent toner for electrostatic charge development according to this embodiment includes toner base particles produced, for example, by the dissolution suspension method. Specifically, the transparent toner according to this embodiment includes toner base particles produced by: mixing an oil phase containing at least a binder resin and an additive(s) dissolved or dispersed in an organic solvent with an aqueous phase containing inorganic particles as a dispersant dispersed in an aqueous solvent to form a suspension, thereby producing oil phase droplets having the inorganic particles adhered to the surface thereof; then removing the solvent; and adding an acid to remove the inorganic particles.

[Binder Resin]

Examples of the binder resin include, but are not particularly limited to, homopolymers of monomers, such as styrenes, such as styrene, p-chlorostyrene, and α-methylstyrene; esters with a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinylnitriles, such as acrylonitrile and methacrylonitrile; vinyl ethers, such as vinyl methyl ether and vinyl isobutyl ether; vinyl ketones, such as vinyl methyl ketone, vinyl ethyl ketone, and vinyl isopropenyl ketone; and polyolefins of ethylene, propylene, butadiene, and the like. In addition, the binder resins include copolymers of these monomers and mixtures of these. Furthermore, the binder resins include non-vinyl condensation resins, such as epoxy resins, polyester resins, polyurethane resins, polyamide resins, cellulose resins, and polyether resins, and mixtures thereof with vinyl resins, and graft polymers obtained by polymerization of vinyl monomers in the presence of these.

In this embodiment, polyester resins are used. Polyester resins as the binder resin preferably have a glass transition point ($T_g$) of 61.4° C. to 63.1° C., both inclusive, and a melt temperature in the 1/2 method of 106.0° C. to 109.6° C., both inclusive.

The polyester resins as the binder resin are modified with the long chain alkyl group of chemical formula (1) below to improve the hydrophobicity.

[Formula 1]

CHEMICAL FORMULA (1)

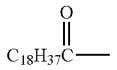

The polyester resins modified with the long chain alkyl group of chemical formula (1) can be produced by the condensation polymerization of an alcohol component(s) and a carboxylic acid component(s). For the transparent toner according to this embodiment, polyesters obtained by the condensation polymerization of an alcohol component(s) and a carboxylic acid component(s) can be used.

Examples of the alcohol component include dihydric or higher alcohols and alcohol derivatives, such as ethylene glycol, diethylene glycol, triethylene glycol, polyethylene glycol, propylene glycol, butanediol, pentanediol, hexanediol, cyclohexanedimethanol, xylene glycol, dipropylene glycol, polypropylene glycol, bisphenol A, hydrogenated bisphenol A, bisphenol A ethylene oxide, bisphenol A propylene oxide, sorbitol, and glycerol.

Examples of the carboxylic acid component include polycarboxylic acids, carboxylic acid derivatives, and succinic anhydrides, such as maleic acid, fumaric acid, phthalic acid, isophthalic acid, terephthalic acid, succinic acid, adipic acid, trimellitic acid, pyromellitic acid, cyclopentane dicarboxylic acid, succinic anhydride, trimellitic anhydride, maleic anhydride, and dodecenylsuccinic anhydride.

The alcohol components and the carboxylic acid components may be used in combination of two or more, respectively.

[Organic Solvent]

General organic solvents can be used as organic solvents for producing the oil phase. Examples of organic solvents include esters, such as methyl acetate, ethyl acetate, and butyl acetate. Examples of organic solvents also include hydrocarbons, such as toluene and xylene; halogenated hydrocarbons, such as methylene chloride, chloroform, and dichloroethane; alcohols, such as methanol and ethanol; and ketones, such as acetone, methyl ethyl ketone, and cyclohexanone. The organic solvents may be used in mixtures of two or more.

[Release Agent]

Release agents improve the fixability and offset resistance of toner. Examples of release agents include petroleum waxes, such as paraffin wax and oxidized paraffin wax; synthetic waxes, such as polyolefin wax and oxidized polyolefin wax; ester waxes; ether waxes; and waxes derived from animals and plants.

[Aqueous Medium]

Water is mainly used as an aqueous medium for producing the aqueous phase. The aqueous medium may be a mixture of water and a water-soluble solvent.

[Inorganic Dispersant]

Inorganic particles can be used for a suspension stabilizer as an inorganic dispersant. Examples of the suspension stabilizer include tricalcium phosphate, hydroxyapatite, calcium carbonate, titanium oxide, aluminum hydroxide, magnesium hydroxide, barium sulfate, and silica.

[External Additive and Others]

Transparent toner is applied onto color toner or record media such as paper to obtain glossiness. Accordingly, the transparent toner is prepared to allow a visual recognition of the color toner when being applied on the color toner, or allows a visual recognition of the record media when being applied on the record media. The transparent toner may be produced by being blended with a fluorescent brightening agent, instead of being blended with a colorant. In addition, for example, inorganic particles (for example, silicon dioxide, and titanium dioxide) are externally added as an external additive to the transparent toner.

(A-2) Production of Transparent Toners for Electrostatic Charge Development

The production of transparent toners according to the embodiment is described below by way of Examples and Comparative Examples along with their evaluation results.

The evaluation results are based on the following: the glass transition point and the melt temperature, indicative of the softening point by the 1/2 method, of produced transparent toners; the toner shelf life; the glossiness of the toners in prints where a laminate of T (transparent), Y (yellow), M (magenta), and C (cyan) toners on intermediate transfer belt 11 is secondarily transferred in tandem-type image formation apparatus 1; the difference in glossiness between transparent toner areas and color toner areas; and the toner spreading in the secondary transfer.

The Examples and Comparative Examples below illustrate the case where toner base particles of the transparent toners are produced by the dissolution suspension method.

The dissolution suspension method, as described above, includes (a) an aqueous-phase preparation step for preparing an aqueous medium containing a dispersed dispersant (inorganic dispersant), (b) an oil-phase preparation step for preparing an oil phase by the addition of a binder resin and a release agent to an organic solvent, (c) a particle-formation step for forming particles by the introduction of the oil phase into the aqueous phase and the removal of the organic solvent, (d) a toner-base-particle formation step for forming toner base particles by the dehydrating of the particles in the solution and subsequent acid cleaning to dissolve a suspension stabilizer, followed by another acid cleaning and drying, and (e) an external addition step for adding an external additive to the produced toner base particles.

As described above, the polyester resins modified with the long chain alkyl group of chemical formula (1) to improve the hydrophobicity are used as the binder resin.

According to tandem-type image formation apparatus 1 in FIG. 1, the amount of the color toners applied to the record medium is about 0.4 mg/cm$^2$. Conventionally, the amount of the transparent toner applied to the record medium is about 0.7 mg/cm$^2$ to provide a difference in glossiness between transparent toner areas (image areas containing the transparent developer) and color toner areas (image areas not containing the transparent developer) through spot gloss. Accordingly, when color toner layers of different colors are laminated on the transparent toner layer on intermediate transfer belt 11, intermediate transfer belt 11 fails to hold the color toners strongly, which may cause color toner spreading in the secondary transfer.

Even when the thickness of the toner layer of transparent toner 104 applied to intermediate transfer belt 11 (i.e., the amount of the transparent toner applied to a record medium) is decreased in this embodiment, the difference in glossiness from the color toner areas can be kept and the toner spreading in the secondary transfer can be also prevented at the same time.

Example 1

(a) Aqueous-Phase Preparation Step

First, to obtain an aqueous medium containing a dispersed inorganic dispersant, 650 parts by weight of an industrial trisodium phosphate dodecahydrate is mixed with 19540 parts by weight of pure water and dissolved at a liquid temperature of 60° C. Then, dilute nitric acid for pH adjustment is added to the mixture. Into the resulting mixture, a calcium chloride aqueous solution containing 320 parts by weight of an industrial calcium chloride anhydride dissolved in 2560 parts by weight of pure water is introduced, and stirred with a Neo-Mixer (produced by PRIMIX Corporation) at a high speed of 4300 rpm/min for 34 minutes while keeping the liquid temperature at 60° C., thereby preparing an aqueous phase containing a suspension stabilizer (dispersant).

(b) Oil-Phase Preparation Step

Next, a method of preparing an oil phase containing a polyester resin as a binder resin is described.

While stirring 3120 parts by weight of ethyl acetate as an organic solvent under heating at a liquid temperature of 50° C., 17 parts by weight of a paraffin wax (melting point: 62° C.) and 1.4 parts by weight of an optical bleaching agent are sequentially added to ethyl acetate. Then, into the obtained mixture, 640 parts by weight of a polyester resin having a glass transition point ($T_g$) of 61.9° C., a melt temperature ($T_{1/2}$), indicative of a softening point by the 1/2 method as measured with a flow tester, of 107.3° C., and a weight-average molecular weight of 11000 is introduced and stirred until solid matters are dissolved, thereby preparing an oil phase.

(c) Particle Formation Step

Next, the aqueous phase is cooled to 55° C., and then the above oil phase is introduced dropwise into the aqueous phase and stirred at 1000 rpm/min for 5 minutes with a Neo-Mixer (produced by PRIMIX Corporation) to form a suspension, thereby forming particles. Ethyl acetate is then removed by a vacuum distillation.

(d) Toner-Base-Particle Formation Step

After the toner in the liquid is dehydrated once, the dehydrated toner is dispersed in pure water again to form a slurry containing the toner. To the slurry, nitric acid is added to decrease the pH to 1.5 or less for acid cleaning to dissolve tricalcium phosphate as a suspension stabilizer, followed by dehydration. The dehydrated toner is further dispersed in pure water again and stirred, followed by an aqueous cleaning. The toner is then dehydrated and dried to produce a toner.

(e) External Addition Step

Next, the external addition step involves adding to 100 parts by weight of the produced toner, 1.0 part by weight of hydrophobic silica RX50 (produced by Nippon Aerosil Co., Ltd., average primary particle size: 40 nm) and 0.8 parts by weight of hydrophobic silica RX200 (produced by Nippon Aerosil Co., Ltd., average primary particle size: 12 nm) and mixing the obtained mixture at a rotation speed of 5400 rpm/min for 10 minutes with a 10 liter-volume Henschel mixer to obtain a toner having a glass transition point ($T_g$) of 64.7° C. and a melt temperature ($T_{1/2}$), indicative of the softening point by the 1/2 method, of 95.9° C.

Example 2

In Example 2, the binder resin used in the oil-phase preparation step (b) is a polyester resin having a glass transition point ($T_g$) of 63.1° C., a melt temperature ($T_{1/2}$) of 109.6° C., and a weight-average molecular weight of 12000 instead of the polyester resin in Example 1. The other conditions are the same as in Example 1. The toner production step is also the same as in Example 1. This produces a toner having a glass transition point ($T_g$) of 66.0° C. and a melt temperature ($T_{1/2}$) of 97.0° C.

Example 3

In Example 3, the binder resin used in the oil-phase preparation step (b) is a polyester resin having a glass transition point ($T_g$) of 61.4° C., a melt temperature ($T_{1/2}$) of 106.0° C., and a weight-average molecular weight of 10000 instead of the polyester resin in Example 1. The other conditions are the same as in Example 1. The toner production step is also the same as in Example 1. This produces a toner having a glass transition point ($T_g$) of 63.0° C. and a melt temperature ($T_{1/2}$) of 94.3° C.

Comparative Example 1

In Comparative Example 1, the binder resin used in the oil-phase preparation step (b) is a polyester resin having a glass transition point ($T_g$) of 65.5° C., a melt temperature ($T_{1/2}$) of 107.7° C., and a weight-average molecular weight of 10000 instead of the polyester resin in Example 1. The other conditions are the same as in Example 1. The toner production step is also the same as in Example 1. This produces a toner having a glass transition point ($T_g$) of 68.8° C. and a melt temperature ($T_{1/2}$) of 102.2° C.

Comparative Example 2

In Comparative Example 2, the binder resin used in the oil-phase preparation step (b) is a polyester resin having a glass transition point ($T_g$) of 55.6° C., a melt temperature ($T_{1/2}$) of 102.8° C., and a weight-average molecular weight of 11000 instead of the polyester resin in Example 1. The other conditions are the same as in Example 1. The toner production step is also the same as in Example 1. This produces a toner having a glass transition point ($T_g$) of 55.2° C. and a melt temperature ($T_{1/2}$) of 89.2° C.

Comparative Example 3

In Comparative Example 3, the binder resin used in the oil-phase preparation step (b) is a polyester resin having a glass transition point ($T_g$) of 67.7° C., a melt temperature ($T_{1/2}$) of 124.7° C., and a weight-average molecular weight of 20000 instead of the polyester resin in Example 1. The other conditions are the same as in Example 1. The toner production step is also the same as in Example 1. This produces a toner having a glass transition point ($T_g$) of 72.4° C. and a melt temperature ($T_{1/2}$) of 112.2° C.

Comparative Example 4

In Comparative Example 4, the binder resin used in the oil-phase preparation step (b) is a polyester resin having a glass transition point ($T_g$) of 60.4° C., a melt temperature ($T_{1/2}$) of 105.4° C., and a weight-average molecular weight of 10000 instead of the polyester resin in Example 1. The other conditions are the same as in Example 1. The toner production step is also the same as in Example 1. This produces a toner having a glass transition point ($T_g$) of 62.7° C. and a melt temperature ($T_{1/2}$) of 92.8° C.

[Method of Measuring Glass Transition Point of Toners]

The glass transition point ($T_g$) of the toners produced above is measured in the following manner. First, 10 mg of the produced toner is placed in an aluminum pan, and the glass transition point of the toner is measured with a differential scanning calorimeter "DSC6220" (produced by Seiko Instruments Inc.). The measurement conditions are a starting temperature of 20.0° C. and a heating rate of 10° C./min.

[Method of Measuring the Melt Temperature of Toners]

For the melt temperature ($T_{1/2}$) of the toners, 1.0 g of the produced toner is pelletized, and the melt temperature ($T_{1/2}$) of the pelletized toner is measured with a flow characteristic evaluation device (flow tester) "CFT-500D" (produced by Shimadzu Corporation). The measurement conditions are a starting temperature of 50.0° C., a heating rate of 3° C./min, a load of 10 kg, and a die hole size of 1 mm.

[Method of Measuring the Toner Shelf Life]

Toner shelf life is to determine the storage conditions of the toner while the toner is transported or stored to/in toner container 101, or so. The method of measuring the toner shelf life involves: disposing a metal cylinder 30 mm in diameter and 80 mm in height on a glass plate; introducing 10 g of each toner in the cylinder; and allowing the toner to stand in the environment at a temperature of 50° C. and a humidity of 55% for 48 hours while placing a 20 g weight on the toner. The weight and the cylinder are then removed slowly, and the weight is placed in increments of 10 g on the toner to determine the load to collapse the toner. If the toner collapses after the removal of the cylinder, then the collapse load is 0 g.

A smaller collapse load to collapse the toner results in a better toner shelf life, and thus the collapse load of 0 g is determined to provide the best toner shelf life. The toner shelf life is associated with the glass transition point ($T_g$) of the toner. For example, a higher glass transition point ($T_g$) of the toner easily causes a collapse of the toner to give a smaller collapse load, thus increasing the toner shelf life. In contrast, a lower glass transition point ($T_g$) of the toner causes solidification of the toner to give a larger collapse load, decreasing the toner shelf life.

[Method of Evaluating the Glossiness]

The glossiness is evaluated by a printing involving exposure, development, transfer, and fixation with T (transparent), Y (yellow), M (magenta), and C (cyan) toners in tandem-type image formation apparatus 1. The fixation temperature of fixer 20 is appropriately varied within a range of 130° C. to 190° C. The printing is carried out with A4 long edge feed (paper length in feed direction: 210 mm) at a print speed of 16 ppm (5.6 cm/sec).

On prints formed are, for example, color toner areas including color toners of three colors of Y (yellow), M (magenta), and C (cyan) and transparent toner areas including an overlap of the transparent toner and color toners of the three colors of Y (yellow), M (magenta), and C (cyan). For example, the color toner areas and the transparent toner areas, each of about several centimeters square, are printed on record media.

To measure the glossiness, the gloss characteristic (glossiness) of the transparent toner areas on the prints printed when the toner is fixed to the record medium with a varying fixation temperature within the range of 130° C. to 190° C. is measured with a digital gloss meter (GM-26D, Murakami Color Research Laboratory. Co., Ltd.) at an angle of 75 degrees. The record medium used for the printing is glossy paper (excellent gloss, weight 128 g/m$^2$).

The glossiness is evaluated based on the following criteria: the measured values obtained by varying the fixation temperature is "85 or more for excellent; "70 or more and less than 85 for good"; "50 or more and less than 70 for fair"; and "less than 50 for poor."

The amount of color toners of Y (yellow), M (magenta), and C (cyan) applied to the record medium is 0.4 mg/cm$^2$ like in the conventional manner. The amount of the transparent toner applied to the record medium is 0.4 or 0.5 mg/cm$^2$.

Here, the method of measuring the amount of the toner applied is described. First, in the solid printing of the transparent toner alone, the toner is transferred to a record medium, and the cover of image formation apparatus 1 is opened to stop printing forcibly before the record medium enters into fixer 20. The record medium is taken out of image formation apparatus 1, and the toner transferred to the record medium is collected with a double-stick tape of 1 cm$^2$ area stuck to a metal jig to measure the amount of the toner applied based on the weight change of the jig.

The reason that the amount of the transparent toner applied is 0.4 or 0.5 mg/cm$^2$ is described. As described above, to prevent the toner spreading in the secondary transfer, the thickness of the toner layer is desirably decreased (that is, the amount of the toner applied to the record medium is desirably smaller). However, the amount of the transparent toner applied of 0.3 mg/cm$^2$ or less reduces the glossiness produced by the transparent toner and fails to keep the glossiness specified by the standard. On the other hand, as described above, in conventional tandem-type image formation apparatus 1, about 0.4 mg/cm$^2$ of each of the color toners is applied to the record medium, whereas about 0.7 mg/cm$^2$ of the transparent toner is applied. Accordingly, the amount of the transparent toner applied is desirably less than 0.7 mg/cm$^2$, and the amount of the transparent toner applied of 0.6 mg/cm$^2$ even causes slight toner spreading. In this embodiment, the amount of the transparent toner applied is 0.4 mg/cm$^2$ to 0.5 mg/cm$^2$, both inclusive, to prevent the toner spreading while maintaining the glossiness due to spot gloss.

[Method of Evaluating the Difference in Glossiness]

The difference in glossiness is evaluated by measuring the glossiness of the color toner areas and the glossiness of the transparent toner areas in one and the same print in the same measurement method as in the above method of evaluating the glossiness, as well as the temperature range (here, fixation temperature range) where the difference in glossiness between the transparent toner areas and the color toner areas is "15 or more."

The difference in glossiness is evaluated based on the following criteria: when the glossiness of the transparent toner areas is "70 or more" and the temperature range, where the difference in glossiness between the transparent toner areas and the color toner areas is "15 or more," is "20° C. or more", then it is rated as "good." In the other case, i.e., when the glossiness of the transparent toner areas is "less than 70" and/or the temperature range, where the difference in glossiness between the transparent toner areas and the color toner areas is "15 or more," is "less than 20° C.", then it is rated as "poor."

Here, the reason is described for why the difference in glossiness is evaluated based on the following criteria: when the glossiness of the transparent toner areas is "70 or more" and the temperature range, where the difference in glossiness between the transparent toner areas and the color toner areas is "15 or more," is "20° C. or more", then it is rated as "good."

First, the glossiness of the transparent toner areas is set to "70 or more" as a criterion for determining the effect of the glossiness due to spot gloss using the transparent toner.

In addition, the reason to determine whether the temperature range where the difference in glossiness between the transparent toner areas and the color toner areas is "15 or more" is "20° C. or more" is to ensure that the transparent toner can be used properly even when the fixation temperature of fixer 20 varies.

Figure 5:
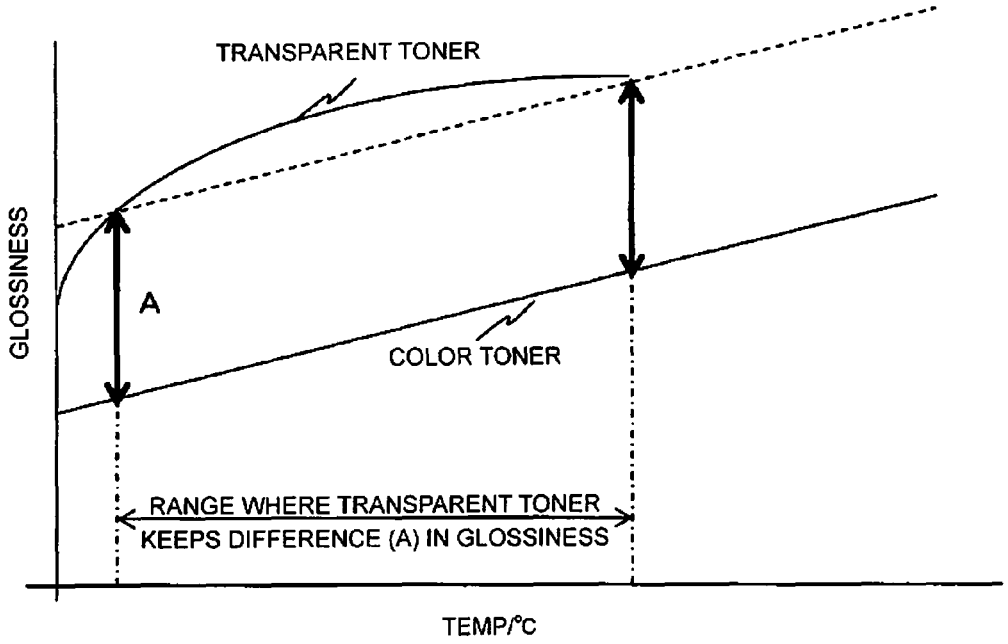
FIG. 5 is a conceptual figure describing the relationship between the gloss characteristic and the temperature of the color toner and the transparent toner.

FIG. 5 is a conceptual figure describing the relationship between the gloss characteristic and the temperature for the color toner and the transparent toner. As illustrated in FIG. 5, toner generally exerts the glossiness as the fixation temperature increases. The same is true for color toner. The glossiness of color toner gradually increases as the fixation temperature increases. The temperature of fixer 20 is relatively low at the power ON condition of image formation apparatus 1, but it becomes relatively high after a continuous printing or when a long period of time elapses after the power is ON, generating the span of the fixation temperature. Accordingly, when the range where the notable glossiness due to the addition of the transparent tone is kept beyond the glossiness of the color toner areas composed only of the color toner (the temperature range where the difference A in glossiness is kept at 15 or more in the example of FIG. 5) is "20° C." or more, it is rated as good. This permits an evaluation of the transparent toner for its capability to keep the effect of the glossiness due to spot gloss even when the fixation temperature varies over the predetermined range.

[Method of Evaluating the Color Toner Spreading]

To evaluate color toner spreading, in tandem-type image formation apparatus 1, exposure, development, transfer, and fixation are carried out so that the toner image of the transparent toner (the amount applied to the record medium: 0.4 or 0.5 mg/cm$^2$) overlaps color toner images of superimposed colors of Y (yellow), M (magenta), and C (cyan), followed by the printing of letters at a print speed of 16 ppm and an evaluation through visual observation. The amount of color toners of Y (yellow), M (magenta), and C (cyan) applied to the record medium is 0.4 mg/cm$^2$.

The color toner spreading is evaluated based on the following criteria: no visual observation of spreading for "good", visually observed but acceptable for practical use for "fair", and visually observed and unacceptable for practical use for "poor." For comparison, the color toner spreading is also checked at an amount of the transparent toner applied of 0.7 mg/cm$^2$.

[Evaluation Results]

Table 1 presents the evaluation results of Examples 1 to 3 and Comparative Examples 1 to 4.

TABLE 1

| | | | SHELF | SPREADING | | GLOSSINESS | | DIFFERENCE IN GLOSSINESS | |
|---|---|---|---|---|---|---|---|---|---|
| | Tg (° C.) | $T_{1/2}$ (° C.) | LIFE (g) | 0.4 | 0.5 | 0.4 | 0.5 | 0.4 | 0.5 |
| EXAMPLE 1 | 64.7 | 95.9 | 40 | GOOD | GOOD | EXCELLENT | EXCELLENT | GOOD | GOOD |
| EXAMPLE 2 | 66.0 | 97.0 | 0 | GOOD | GOOD | GOOD | EXCELLENT | GOOD | GOOD |
| EXAMPLE 3 | 63.0 | 94.3 | 90 | GOOD | GOOD | EXCELLENT | EXCELLENT | GOOD | GOOD |
| COMPARATIVE EXAMPLE 1 | 68.8 | 102.2 | 40 | FAIR | FAIR | GOOD | GOOD | POOR | GOOD |
| COMPARATIVE EXAMPLE 2 | 55.2 | 89.2 | 500 | GOOD | GOOD | GOOD | EXCELLENT | GOOD | GOOD |
| COMPARATIVE EXAMPLE 3 | 72.4 | 112.2 | 0 | GOOD | GOOD | POOR | POOR | — | — |
| COMPARATIVE EXAMPLE 4 | 62.7 | 92.8 | 300 | GOOD | GOOD | EXCELLENT | EXCELLENT | GOOD | GOOD |

First, the evaluation results for the color toner spreading are described. When tandem-type image formation apparatus 1 performs exposure, secondary transfer, and fixation with 0.4 mg/cm$^2$ of Y (yellow), M (magenta), and C (cyan) toners applied to the toner image formed with an application of 0.7 mg/cm$^2$ of any of the transparent toners of Examples 1 to 3 and Comparative Examples 1 to 4, the color toner spreading can be visually observed.

In contrast, when the transparent toners of Examples 1, 2, and 3, and Comparative Examples 2, 3, and 4 are used at an applied amount of 0.4 or 0.5 mg/cm$^2$, no color toner spreading is visually observed. Even when the transparent toner of Comparative Example 1 is used at an applied amount of 0.4 or 0.5 mg/cm$^2$, a slight color toner spreading is visually observed, but is acceptable for practical use. This indicates that the applied amount of the transparent toner of 0.4 or 0.5 mg/cm$^2$ is effective for preventing toner spreading.

Next, the discussion is made on the evaluation results of Comparative Examples 1 to 4 and Examples 1 to 3.

The discussion is made on the evaluation results for the transparent toner produced by the method of Comparative Example 1. The transparent toner of Comparative Example 1 has a relatively high glass transition point ($T_g$) of 68.8° C. and thus the collapse load indicative of the shelf life of the transparent toner of Comparative Example is 40 g. The transparent toner of Comparative Example 1 has a relatively high melt temperature ($T_{1/2}$) of 102.2° C. Because of the relatively high melt temperature ($T_{1/2}$), the glossiness of the transparent toner areas having the applied amount of 0.4 to 0.5 mg/cm$^2$ is 70 or more at a fixation temperature of 150° C. or more. However, when the fixation temperature at which the glossiness of the transparent toner areas is 70 or more is relatively high, i.e., 150° C. or more, in this way, the glossiness of the color toners also increases. Accordingly, the temperature range ensuring that the difference in glossiness between the color toner areas and the transparent toner areas is 15 or more is "from 151 to 173° C." for the applied amount of 0.5 mg/cm$^2$, but is "from 150 to 163° C." for the applied amount of 0.4 mg/cm$^2$, which is quite narrower than the former.

The discussion is made on the evaluation results for the transparent toner produced by the method of Comparative Example 2. The transparent toner of Comparative Example 2 has a relatively low melt temperature ($T_{1/2}$) of 89.2° C. Because of this relatively low melt temperature ($T_{1/2}$), the glossiness of the transparent toner areas having the applied amount of 0.4 to 0.5 mg/cm$^2$ is 70 or more at a fixation temperature of about 140° C. The temperature range where the difference in glossiness with the color toner areas is 15 or more is "from 140 to 171° C." at an applied amount of 0.5 mg/cm$^2$, and "from 140 to 165° C." even at an applied amount of 0.4 mg/cm$^2$, which are wider by 10° C. or more than that in Comparative Example 1. The toner of Comparative Example 2, however, has a low glass transition point ($T_g$) of 55.2° C. and thus the collapse load indicative of the shelf life of the transparent toner of Comparative Example 2 is 500 g, which is not preferred in terms of the shelf life of the toner.

The discussion is made on the evaluation results for the transparent toner produced by the method of Comparative Example 3. The transparent toner of Comparative Example 3 has a relatively high glass transition point ($T_g$) of 72.4° C. and thus the collapse load indicative of the shelf life of the transparent toner of Comparative Example 3 is 0 g, which is preferred in terms of the shelf life of the toner. The transparent toner of Comparative Example 3 has a relatively high melt temperature ($T_{1/2}$) of 112.2° C. Because of this high melt temperature ($T_{1/2}$), the glossiness of the transparent toner areas having the applied amount of 0.4 to 0.5 mg/cm$^2$ is less than 50. For this, the difference in glossiness between the color toner areas and the transparent toner areas is not evaluated because the difference in glossiness is only evaluated when the glossiness of the transparent toner areas is "70 or more".

The discussion is made on the evaluation results for the transparent toner produced by the method of Comparative Example 4. The transparent toner of Comparative Example 4 has a relatively low melt temperature ($T_{1/2}$) of 92.8° C. Because of this relatively low melt temperature ($T_{1/2}$), the glossiness of the transparent toner areas having the applied amount of 0.4 to 0.5 mg/cm$^2$ is 85 or more at a fixation temperature of about "160° C.". The temperature range where the difference in glossiness with the color toner areas is 15 or more is "from 138 to 169° C." at an applied amount of 0.5 mg/cm$^2$, and "from 144 to 168° C." even at an applied amount of 0.4 mg/cm$^2$, which are wider than that in Comparative Example 1. The toner of Comparative Example 4, however, has a low glass transition point ($T_g$) of 62.7° C. and thus the collapse load indicative of the shelf life of the transparent toner of Comparative Example 4 is 300 g, which is not preferred in terms of the shelf life of the toner.

The discussion is made on the evaluation results for the transparent toner produced by the method of Example 1. The transparent toner of Example 1 has a relatively high glass transition point ($T_g$) of 64.7° C. and thus the collapse load indicative of the shelf life of the transparent toner of Example 1 is 40 g, which is preferred in terms of the shelf life of the toner. The transparent toner of Example 1 has a relatively low melt temperature ($T_{1/2}$) of 95.9° C. Because of this relatively low melt temperature ($T_{1/2}$), the glossiness of the transparent toner areas having the applied amount of 0.4 to 0.5 mg/cm$^2$ is 70 or more at a fixation temperature of about 140° C. The temperature range where the difference in glossiness with the color toner areas is 15 or more is "from 138 to 173° C." at an applied amount of 0.5 mg/cm$^2$, and "from 144 to 172° C." even at an applied amount of 0.4 mg/cm$^2$, which provides a preferred difference in glossiness.

The discussion is made on the evaluation results for the transparent toner produced by the method of Example 2. The transparent toner of Example 2 has a relatively high glass transition point ($T_g$) of 66.0° C. and thus the collapse load indicative of the shelf life of the transparent toner of Example 2 is 0 g, which is preferred in terms of the shelf life of the toner. The transparent toner of Example 2 has a relatively low melt temperature ($T_{1/2}$) of 97.9° C. Because of this relatively low melt temperature ($T_{1/2}$), the glossiness of the transparent toner areas having the applied amount of 0.4 to 0.5 mg/cm$^2$ is 70 or more at a fixation temperature of about 140° C. The temperature range where the difference in glossiness with the color toner areas is 15 or more is "from 145 to 173° C." at an applied amount of 0.5 mg/cm$^2$, and "from 145 to 165° C." at an applied amount of 0.4 mg/cm$^2$, which provides a preferred difference in glossiness.

Here, further discussion is made on the toner shelf life. As described above, a higher glass transition point ($T_g$) of the toner easily causes collapse of the toner to give a smaller collapse load of the toner, thus increasing the toner shelf life. However, the collapse load of the toner may be affected not only by the glass transition point ($T_g$) of the toner, but also by the particle size of the toner and the like. The collapse load indicative of the shelf life of the toners of Comparative Example 1 and Examples 1 and 3 can be affected not only by the glass transition point ($T_g$), but also by the particle size of the toners and the like, as described above.

The discussion is made on the evaluation results for the transparent toner produced by the method of Example 3. The transparent toner of Example 3 has a glass transition point ($T_g$) of 63.0° C. and thus the collapse load indicative of the shelf life of the transparent toner of Example 3 is 90 g. The transparent toner of Example 3 has a relatively low melt temperature ($T_{1/2}$) of 94.3° C. Because of this relatively low melt temperature ($T_{1/2}$), the glossiness of the transparent toner areas having the adhesion amount of 0.4 to 0.5 mg/cm$^2$ is 70 or more at a fixation temperature of about 140° C. The temperature range where the difference in glossiness with the color toner areas is 15 or more is "from 137 to 176° C." at an applied amount of 0.5 mg/cm$^2$, and "from 143 to 171° C." even at an applied amount of 0.4 mg/cm$^2$, which provides a preferred difference in glossiness.

(A-3) Effect of the Embodiment

As described above, the transparent toner having a glass transition point ($T_g$) of 63.0° C. to 66.0° C., both inclusive, and a melt temperature ($T_{1/2}$), indicative of the softening point by the 1/2 method, of 94.3° C. to 97.0° C., both inclusive, is applied at 0.4 mg/cm$^2$ to 0.5 mg/cm$^2$, both inclusive, so that no toner spreading occurs even in printing by an intermediate transfer and a sufficient difference in glossiness between the transparent toners areas and the color toner areas can be achieved.

(B) Other Embodiments

Although various modifications are illustrated in the above embodiment, the invention can be applied to the following modified embodiments.

In the above embodiment, the case is illustrated where the transparent toners are produced by the dissolution suspension method. However, the method of producing the transparent toners is not limited to the dissolution suspension method, and other methods can be also employed for producing the transparent toners. For example, other methods may include the melt kneading method. The melt kneading method involves using pulverized toner obtained by the method of including a melt kneading step and a pulverization step of materials including a binder resin. To produce the pulverized toner by the melt kneading method, for example, materials, such as a binder resin, colorant, and charge control agent, are uniformly mixed with a mixer, such as a Henschel mixer; and then the obtained mixture is melt-kneaded with a closed-type kneader, a single- or twin-screw extruder, an open roll type kneader, or the like, followed by cooling, pulverization and classification. Even when the transparent toner produced by the above method is used, the color toner spreading can be prevented and also the glossiness can be kept even at a reduced applied amount of the transparent toner.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A transparent developer with a glass transition point of 63.0° C. to 66.0° C., both inclusive, and a melt temperature, indicative of a softening point by a 1/2 method, of 94.3° C. to 97.0° C., both inclusive.

2. The transparent developer according to claim 1, with a collapse load, indicative of a shelf life of the transparent developer, of 0 g to 90 g, both inclusive.

3. The transparent developer according to claim 1, wherein the transparent developer is obtained by dispersing, in an aqueous medium containing a dispersed inorganic dispersant, an oil phase component including at least a binder resin and an additive dissolved or dispersed in an organic solvent to form particles.

4. A developer housing storing therein the transparent developer according to claim 1 to be supplied to an image carrier configured to carry thereon a developer image.

5. A development device comprising:

a developer housing containing the transparent developer according to claim 1; and a developer carrier configured to supply the transparent developer to an image carrier to thereby form a developer image on the image carrier.

6. The development device according to claim 5, wherein an amount of the transparent developer applied to a record medium by image formation is 0.4 $mg/cm^2$ to 0.5 $mg/cm^2$, both inclusive.

7. The development device according to claim 5, wherein an image area containing the transparent developer in an image formed on a record medium achieves a glossiness of 70 or more, and a fixation temperature range where a difference in glossiness between the image area containing the transparent developer and an image area not containing the transparent developer in the image is 15 or more is 20° C. or more.

8. The development device according to claim 5 used for an image formation apparatus in which image carriers each form a transparent developer image or anyone of color developer images of different colors; the transparent developer image formed on one of the image carriers is transferred to an intermediate transfer member and then the color developer images of different colors formed on the other image carriers are sequentially transferred onto the transparent developer image on the intermediate transfer member to form a multilayer; and thereafter the multilayer of the developer images transferred on the intermediate transfer member is secondarily transferred to a record medium by a secondary transfer unit.

9. An image formation apparatus in which image carriers each form a transparent developer image or any one of color developer images of different colors; the transparent developer image formed on one of the image carriers is transferred to an intermediate transfer member and then the color developer images of different colors formed on the other image carriers are sequentially transferred onto the transparent developer image on the intermediate transfer member to form a multilayer; and thereafter the multilayer of the developer images transferred on the intermediate transfer member is secondarily transferred to a record medium by a secondary transfer unit, and wherein a transparent developer used for the transparent developer images is the transparent developer according to claim 1.

10. An image formation apparatus, comprising:

a first development device configured to supply the transparent developer according to claim 1 to a first image carrier and thereby forming a transparent developer image on the first image carrier, second development devices configured to supply color developers of deferent colors onto second image carriers and thereby forming color developer images of deferent colors onto the second image carriers, respectively;

an intermediate transfer member;

a primary transfer unit configured to transfer the transparent developer image from the first image carrier to the intermediate transfer member and then to sequentially transfer the color developer images of different colors onto the transparent developer image on the intermediate transfer member, thereby forming a multilayer of the developer images; and a secondary transfer unit configured to secondarily transfer the multilayer of the developer images from the intermediate transfer member onto a record medium.

* * * * *